US007972480B2

(12) United States Patent
Huhtala et al.

(10) Patent No.: US 7,972,480 B2
(45) **Date of Patent: *Jul. 5, 2011**

(54) APPARATUS FOR REMOVING A BROKEN PULP WEB FROM A PULP DRYER

(75) Inventors: Olli Huhtala, Merimasku (FI); Markku Laitonen, Masku (FI); Johan Lindholm, Turku (FI); Timo Vuokko, Piikkiö (FI); Ilkka Eivola, Naantali (FI)

(73) Assignee: Metso Paper, Inc., Helsinki (FI)

( * ) Notice: Subject to any disclaimer, the term of this patent is extended or adjusted under 35 U.S.C. 154(b) by 260 days.

This patent is subject to a terminal disclaimer.

(21) Appl. No.: 12/086,265

(22) PCT Filed: Dec. 5, 2006

(86) PCT No.: PCT/FI2006/000405

§ 371 (c)(1),
(2), (4) Date: Oct. 10, 2008

(87) PCT Pub. No.: WO2007/065968

PCT Pub. Date: Jun. 14, 2007

(65) Prior Publication Data

US 2009/0236066 A1 Sep. 24, 2009

(30) Foreign Application Priority Data

Dec. 5, 2005 (FI) ..... 20051258

(51) Int. Cl.
*D21G 3/00* (2006.01)

(52) U.S. Cl. ..... 162/272; 162/199

(58) Field of Classification Search ..... 162/272, 162/199, 264; 34/525; 83/53
See application file for complete search history.

(56) References Cited

U.S. PATENT DOCUMENTS 3,011,733 A * 12/1961 Ford ..... 162/255
3,620,110 A * 11/1971 Smith, Jr. ..... 83/66
3,669,830 A 6/1972 Williams
5,471,766 A 12/1995 Heikkilä et al.
5,791,067 A * 8/1998 Bendtsen ..... 34/425
5,935,381 A * 8/1999 Trokhan et al. ..... 162/109

(Continued)

FOREIGN PATENT DOCUMENTS

EP 0 195 757 1/1985

(Continued)

OTHER PUBLICATIONS

International Search Report and Written Opinion of the International Searching Authority issued in the underlying International PCT Application No. PCT/FI2006/000405.

*Primary Examiner* — Mark Halpern
(74) *Attorney, Agent, or Firm* — Cohen Pontani Lieberman & Pavane LLP

(57) ABSTRACT

The invention relates to an apparatus and a method for removing a broken pulp web from a pulp dryer. The apparatus includes a maintenance platform arranged at the first or the second end of the pulp dryer, outside the walls of the pulp dryer; a device for shifting the maintenance platform in a substantially vertical direction to a desired height with respect to the pulp dryer, and an extraction device fixed to the edge of the maintenance platform facing the dryer for pulling a broken pulp web out of the pulp dryer.

10 Claims, 6 Drawing Sheets

U.S. PATENT DOCUMENTS

| | | | | |
|---|---|---|---|---|
| 6,358,367 | B1 * | 3/2002 | Doelle et al. | 162/194 |
| 6,524,443 | B2 * | 2/2003 | Doelle et al. | 162/264 |
| 7,363,730 | B2 * | 4/2008 | Huhtala et al. | 34/525 |

FOREIGN PATENT DOCUMENTS

| | | | |
|---|---|---|---|
| EP | 0 690 168 | | 1/1996 |
| FI | 20050034 | * | 1/2005 |
| WO | WO 98/06897 | | 2/1998 |
| WO | WO 99/19563 | | 4/1999 |
| WO | WO 01/42118 | | 6/2001 |
| WO | WO 02/101143 | | 12/2002 |

* cited by examiner

APPARATUS FOR REMOVING A BROKEN PULP WEB FROM A PULP DRYER

CROSS-REFERENCE TO THE RELATED APPLICATION

This is a U.S. national stage of International Patent Application No. PCT/FI2006/000405, filed on Dec. 5, 2006 claiming prior to application no. FI 20051258, filed in Finland on Dec. 5, 2005, the content of which is incorporated here by reference.

TECHNICAL FIELD OF THE INVENTION

The object of the invention is an apparatus and a method for removing a broken pulp web from a pulp dryer.

BACKGROUND OF THE INVENTION

In a pulp dryer, a web formed of pulp, i.e. a pulp web, is conveyed along a multi-layered path by floating it on an air cushion formed by blow nozzles. The blow nozzles are arranged in several superimposed, generally horizontal nozzle levels almost having the length of the pulp dryer. The pulp web is typically introduced in the pulp dryer through its first end. Then the pulp web is conveyed along the uppermost nozzle level of the pulp dryer to the second end of the device. At its ends, the device typically comprises turn rolls, over which the pulp web is turned each time to the next lower nozzle level. When the pulp web has been conveyed to the lowest nozzle level of the pulp dryer, the pulp web is removed from the pulp dryer, typically through the second end of the pulp dryer. A pulp dryer typically comprises 15-30 nozzle levels. The gas blown from the blow nozzles is typically hot air, the blow air generally having a temperature in the range of 120-170° C. When reaching the pulp dryer, the pulp web typically has a dry solids content of 48-54%. The dry solids content of the pulp web leaving the pulp dryer is typically 85-95%, most typically approximately 90%. The pulp web typically has a width of 3-9 m. The pulp web is typically conveyed at a speed of 140-220 m/min in the pulp dryer.

The pulp web may break within the dryer for various reasons. In such a situation, the feed of a new pulp web into the pulp dryer is interrupted. However, in the case of a web break, there will typically still remain a large amount of pulp web in the pulp dryer, which web needs to be removed from the device before the production is restarted.

In the case of a web break, the pulp web is currently removed from the dryer by means of extraction devices fixed to maintenance platforms moving vertically at the first end and the second end of the pulp dryer. An extraction device is fixed to that edge of the maintenance platform which is directed away from the dryer, typically at least partly outside the railings of the maintenance platform. The extraction device comprises two horizontal rolls transverse to the direction of movement of the pulp web. The rolls are arranged against each other so that a nip of the extraction device is formed between them. The rolls are arranged to be rotated by machine force. The pulp web needs to be pulled by muscular force from the inside of the dryer to the nip of the extraction device, whereafter the pulp web can be extracted by machine force with the aid of the rolls and further guided to a pulper. The distance over which the pulp web needs to be transferred by manpower is typically 2-3 metres. After a web break, the wet pulp web remains on the nozzle levels and the pulp web will typically have time to dry at least partly before cleaning operations are started. Consequently, friction between the nozzle levels and the web will impede cleaning operations, even though with the aid of nozzle blowing the situation can be made somewhat easier. Extraction of the pulp web from the pulp dryer requires strong force. The operation usually requires 2 or 3 operators.

International patent publication WO 02/101143 discloses a solution, in which a wheel is used for pressing a broken pulp web against a rotating turn roll. In this manner, a pulling nip is formed between the wheel and the turn roll, due to which the pulp web will start moving. In the solution presented either manpower is needed or the device requires installations in the inner parts of the pulp dryer. If an extraction device fixed to the maintenance platform is used in connection with the solution presented in the publication, the device is fixed to that edge of the maintenance platform which is directed away from the pulp dryer. In this case, the broken pulp web needs to be pulled over the maintenance platform such that working on the maintenance platform is difficult or even impossible. The pulp web can also foul the maintenance platform.

SUMMARY OF THE INVENTION

It is an object of the present invention to reduce or even eliminate the above-mentioned problems appearing in the prior art.

The present invention has especially the object of providing a solution for facilitating cleaning operations after a web break in a pulp dryer.

The present invention has especially the object of providing a device allowing rapid and reliable removal of a broken pulp web from a pulp dryer.

The present invention has especially the object of providing a device for removing a broken pulp web from a pulp dryer whereby while using said device, the maintenance platform at an end of the pulp dryer can be used simultaneously in a simple manner.

An object of the present invention is to provide a device for removing a broken pulp web from a pulp dryer which device does not require permanent installations in the inner parts of the pulp dryer.

The embodiments and advantages mentioned in this text are in suitable parts applicable to both the apparatuses and methods according to the invention, even if this is not always specifically mentioned.

A typical apparatus of the invention for removing a broken pulp web from a pulp dryer comprises

- a maintenance platform arranged at the first end or the second end of the pulp dryer;
- means for shifting the maintenance platform in a substantially vertical direction to a desired height with respect to the pulp dryer, and
- an extraction device fixed to the maintenance platform for pulling a broken pulp web out from the pulp dryer.

In a typical apparatus according to the invention, the extraction device is fixed to the edge of the maintenance platform facing the dryer.

A typical pulp dryer according to the invention comprises

- several superimposed nozzle levels on which the pulp web to be dried is arranged to be conveyed;
- several turn rolls for directing the pulp web from one nozzle level to another;
- a wall and a roof which substantially surround the nozzle levels and the turn rolls, and
- an apparatus of the invention for removing a broken pulp web from the pulp dryer.

In a typical method of the invention for removing a broken pulp web from a pulp dryer having several nozzle levels and turn rolls for conveying the pulp web, in which method in case of a web break feeding of the pulp web into the pulp dryer is interrupted;

the maintenance platform at the end of the pulp dryer is shifted to an appropriate height, if necessary;

access doors of a given nozzle level are opened;

the pulp web is conveyed out of the pulp dryer by means of an extraction device through the opened access door;

the pulp web is conveyed via an extraction device arranged to the edge of the maintenance platform facing the dryer, and further the pulp web is conveyed underneath the maintenance platform from between the pulp dryer and the floor level of the maintenance platform.

The maintenance platform typically comprises at least a floor level and railings surrounding it and fixed thereto.

Typical means for shifting the maintenance platform in a substantially vertical direction to a desired height with respect to the pulp dryer comprise substantially vertical rail means to which the maintenance platform is fixed in a mobile manner. The means for shifting the maintenance platform further comprise usually at least one motor and power transmission means serving as a source of power for moving of the maintenance platform, and guides needed for shifting the maintenance platform.

The extraction device typically comprises gripping means for engaging to the pulp web and for moving it with respect to the dryer, and an actuator, such as a manually driven crank, an electric motor or a pneumatic motor;

An extraction device suitable for this invention comprises two adjacent and substantially aligned, generally horizontal rolls. The nip between the rolls can be opened and closed by shifting the first roll with respect to the second roll. Typically at least one of the rolls is driven, so that the pulp web, when extracted from the pulp dryer, can be moved in the process out of the pulp dryer under the driving force of the rolls. At least one of the rolls of the extraction device can be replaced by wheels, reels or other corresponding devices. The extraction device can comprise also other devices with which to grip the broken pulp web or with which to pull the pulp web out of the dryer.

The gripping means of the extraction device are preferably in contact with the pulp web to be extracted over its entire width. If the means comprise two rolls, preferably the length of at least one roll, preferably the length of both rolls is equal or at least almost equal to the width of the pulp web to be extracted. If the gripping means comprise for instance several shorter rolls, which are arranged adjacent to each other such that their longitudinal axis are in succession, the combined length of these rolls is preferably close to the width of the pulp web, for instance 95% of the width of the pulp web.

With an apparatus of the invention a broken pulp web can be easily and safely removed from any nozzle level of the pulp dryer, even from the uppermost and the lowest nozzle levels.

It has now been surprisingly found that a pulp web extraction device fixed to a maintenance platform can be fixed to the maintenance platform edge facing the pulp dryer. This allows the entire floor of the moving maintenance platform to remain as a free operating space for the operators during the extraction of the pulp web. This way, the operators are able to observe the inner part of the dryer during the extraction of the pulp web and to better control the extraction process of the pulp web even in exceptional circumstances. The pulp web is extracted according to the invention into the space remaining between the maintenance platform and the pulp dryer, whereby the fouling of the maintenance platform caused by the extracted pulp web can be minimized and the time used for cleaning of the maintenance platform can be considerably reduced.

With the aid of the invention also working safety during the extraction of the pulp web is increased. One of the advantages of the invention is reducing the amount of manpower needed for removing the pulp web from the pulp dryer. Working conditions at the mill will improve and, at the same time, cleaning operations of the pulp dryer will become easier, faster and safer.

In an embodiment of the invention the means for shifting the maintenance platform in a substantially vertical direction with respect to the pulp dryer comprise substantially vertical rail means, which extend at their upper end above the roof of the pulp dryer. This allows lifting of the maintenance platform even to the level of the pulp dryer roof or even higher. Also a pulp web that has broken on the uppermost nozzle levels can be easily removed by using a maintenance platform of this kind. The rail means typically extend about 0.1-3, preferably 0.3-3, more preferably 0.4-1 m above the roof of the pulp dryer.

In an embodiment of the invention the extraction device comprises means for moving the extraction device in a substantially vertical direction with respect to the maintenance platform itself. The means can be for instance rails or corresponding guiding means arranged on the maintenance platform edge facing the pulp dryer. Such a movable extraction device can be conveniently placed precisely at a suitable working height with respect to both the pulp dryer and the maintenance platform floor.

In another embodiment of the invention the extraction device can be movable with respect to the working level also for instance in a horizontal direction or towards the dryer and away from the dryer. This increases the usability of the apparatus. It is possible, for instance, that the extraction device is fastened to an arm, which is articulated to the maintenance platform, for instance to the railing forming its edge, such that it can be tilted by a desired amount towards the pulp dryer and its turn rolls. This allows further shortening of the distance over which the pulp web needs to be conveyed in order to get it to the extraction device. The shorter the distance between the extraction device and the end of the pulp web to be extracted can be made, the easier and lighter the extraction of the pulp web can be made.

In an embodiment of the invention an apparatus for removing a broken pulp web from a pulp dryer further comprises a gripping system, which comprises:

an actuator, such as a manually driven crank, an electric motor or a pneumatic motor. This actuator of the gripping system is typically the same as the above-mentioned actuator of the extraction device, but it can be separate from it. Even if the gripping system and the extraction device were operated by using the same actuator, the gripping system and the extraction device can usually be controlled and driven independently and autonomously of each other;

a pulling means functionally coupled to the actuator and arranged to be driven by the actuator. A pulling means stands for a wire rope, a chain, a rope or the like, and also means for pulling the wire rope or the like by means of the actuator. The pulling means may for instance comprise a reel around which the chain or the wire rope is collected by wounding the reel by means of the actuator;

a gripping means coupled to the pulling means and comprising means for engaging to the pulp web. Engagement implies that after the gripping means has engaged to the pulp web, i.e. the cellulose web, the pulp web and the gripping means hardly shift with respect to each other at the location of the engagement.

By means of the actuator and the pulling means the gripping means is arranged to be movable with respect to the pulp dryer. By means of this gripping system the engagement to the pulp web to be extracted can be intensified and the pulp web can be pulled out of the inner parts of the pulp dryer without using strong manual force, by fixing a gripping means to the pulp web and by pulling the gripping means out of the pulp dryer by the force of an actuator. When the pulp web has been extracted to some extent from the pulp dryer, it can be e.g. guided into a nip between rotatable rolls of the extraction device, which nip serves for moving the pulp web further out of the pulp dryer. Thereby the broken pulp web is first gripped with the gripping means of the gripping system inside the walls of the pulp dryer, after which the gripping means and along with them the pulp web is pulled towards the extraction device until the extraction device is used for gripping the pulp web.

In an embodiment of the invention the gripping system comprises coupling means for coupling the gripping means detachably to the pulling means. The coupling means may comprise, e.g. a hole or a coupler in the gripping means, into which hole or coupler the pulling means, such as a wire rope or a chain can be detachably coupled. With the aid of the coupling means the gripping means can be easily detached from the pulling means, e.g. in case of a malfunction during the removal of a pulp web.

An embodiment of the invention comprises a gripping system comprising at least two gripping means. Owing to this, even a broad pulp web can be pulled out of the pulp dryer at a relatively low risk of pulp web rupture.

In an embodiment of the invention, the pulling means of the gripping system comprises a differential gear, which is arranged to control the traction force between the gripping means. This further reduces the risk of pulp web rupture.

In an embodiment of the invention, the pulling means of the gripping system comprises a dummy coupling. The dummy coupling allows a pulling means, such as a chain or the like to be moved e.g. from a reel of the pulling means to the edge of the pulp web to be removed. Such a pulling means or its dummy coupling also comprises a locking means, by means of which a chain or the like is relocked in a non-sliding position before the extraction of the pulp web from the pulp dryer is started.

In an embodiment of the invention, the means of the gripping means of the gripping system for engaging to the pulp web comprise a first and a second planar friction means. These planar friction means are arranged to be mutually shifted between at least two positions, i.e.

- a closed position, in which the planes of the first and the second friction means are arranged in their substantial part substantially in mutual contact, and
- an open position, in which the planes of the first and the second friction means are arranged in their substantial part substantially separate from each other.

In the closed position the pulp web is retained between the planes of the friction means and in the open position the pulp web is detached or can be detached from the planes of the friction means. The friction means can be hinged such that in the closed position the planes of the first and the second friction means are set aligned and against each other, while in the open position the planes of the first and the second friction means are at a substantial angle with respect to each other. This angle can be e.g. 30-60 degrees. It is also possible that in the open position the planes of the first and the second friction means are substantially aligned but at a distance from each other. A typical planar friction means has e.g. an area of 25-300 $cm^2$, 25-200 $cm^2$, 50-300 $cm^2$, 50-200 $cm^2$, 75-300 $cm^2$, 75-200 $cm^2$ or 75-150 $cm^2$. It has been discovered that planar friction means of roughly this size, when placed against each other, pull the pulp web out of the pulp dryer at a relatively low risk of pulp web rupture. The planar friction means can naturally also have some other size. The planar plane of the friction means can be mainly straight or curved. The plane may have been formed with various friction-enhancing shapes, such as grooves, recesses, bosses or peaks. It is also clear that the gripping means of the gripping system for engaging to the pulp web can consist of other means than the planar friction means described in this text.

In a method according to the invention the pulp web can be conveyed underneath the maintenance platform totally from outside of the maintenance platform. It is also possible to arrange some kind of an opening in the maintenance platform for the pulp web such that the pulp web travels through the maintenance platform. However, according to the invention typically at least part of the maintenance platform or at least part of the maintenance platform floor is available for the operators of the apparatus during the removal of the pulp web from the pulp dryer according to the invention.

A method of the invention further comprises

- opening the nip between the rolls of the extraction device, if necessary;
- placing the end of the extracted pulp web between the rolls;
- closing the nip of the extraction device so that the extracted pulp web end is retained between the nip;
- rotating the rolls of the extraction device so that the pulp web is extracted from the pulp dryer under traction of the rolls;
- transferring the pulp web extracted from the pulp dryer to a pulper.

A method of the invention further comprises

- cutting the pulp web on that side of the turn roll of the pulp dryer which is opposite to the maintenance platform, but near the turn roll, and
- the cut end of the pulp web is turned away from around the turn roll and out of the opened access doors and placed in the extraction device.

As, according to the invention, the extraction device is arranged near the end wall of the pulp dryer, according to what is presented, the pulp web cut from behind the turn roll can be easily made to extend to the extraction device arranged to the maintenance platform edge facing the pulp dryer without any tearing or pulling. This works out particularly well if the diameter of the turn rolls is large enough. Near the turn roll means that the pulp web is cut behind the turn roll at a distance, which is less than the diameter of the turn roll. For instance, the pulp web can be cut at a distance, which is less than a meter from the lowest or highest point of the turn roll. Especially advantageously the end of a cut pulp web can be made to extend to the extraction device in this manner, if the extraction device is simultaneously arranged to be tilted towards the pulp dryer. Then the distance between the end of the pulp web and the extraction device can be further minimized.

In a method according to the invention, the turn rolls are not used when the pulp web is conveyed out of the pulp dryer by means of an extraction device. The turn rolls are usually always provided with a drive, which is needed for instance during tail threading. They are however usually provided with a dummy coupling with which the drive can be switched off. In this embodiment the pulp web can be pulled out of the pulp dryer only by means of the power generated by the extraction device. In this manner, damaging of the turn rolls can be avoided during removal of the pulp web.

Typically, in order to facilitate the movement of a broken pulp web, the air blows of the pulp dryer's nozzle level/levels are kept on during the execution of the method according to the invention.

BRIEF DESCRIPTION OF THE FIGURES

The invention is described in more detail below with reference to the enclosed schematic drawing, in which.

DETAILED DESCRIPTION OF THE EMBODIMENTS

Figure 2:
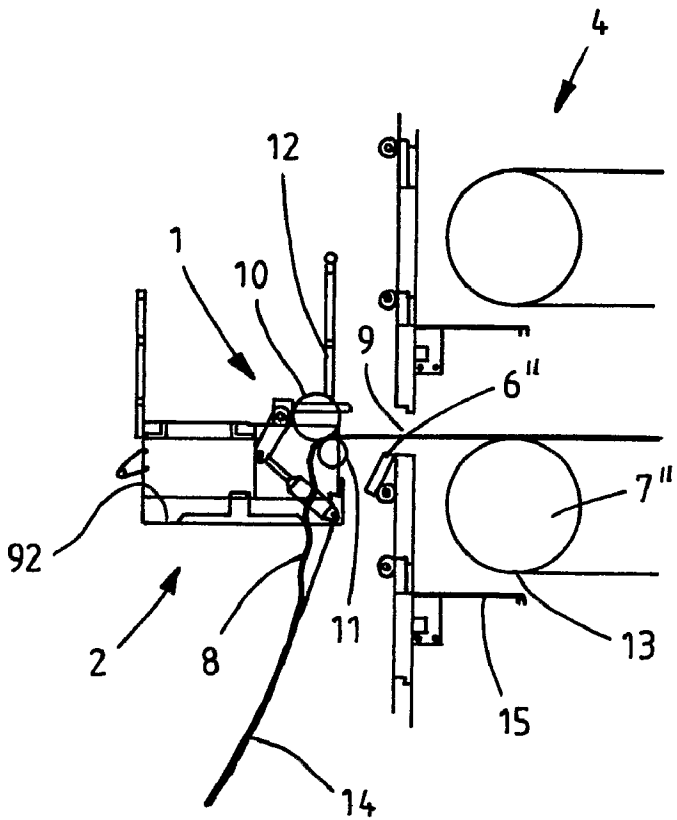
FIG. 2 shows an apparatus according to a first embodiment of the invention.

In the following, the same reference numerals are usually used for parts corresponding to each other.

Figure 1:
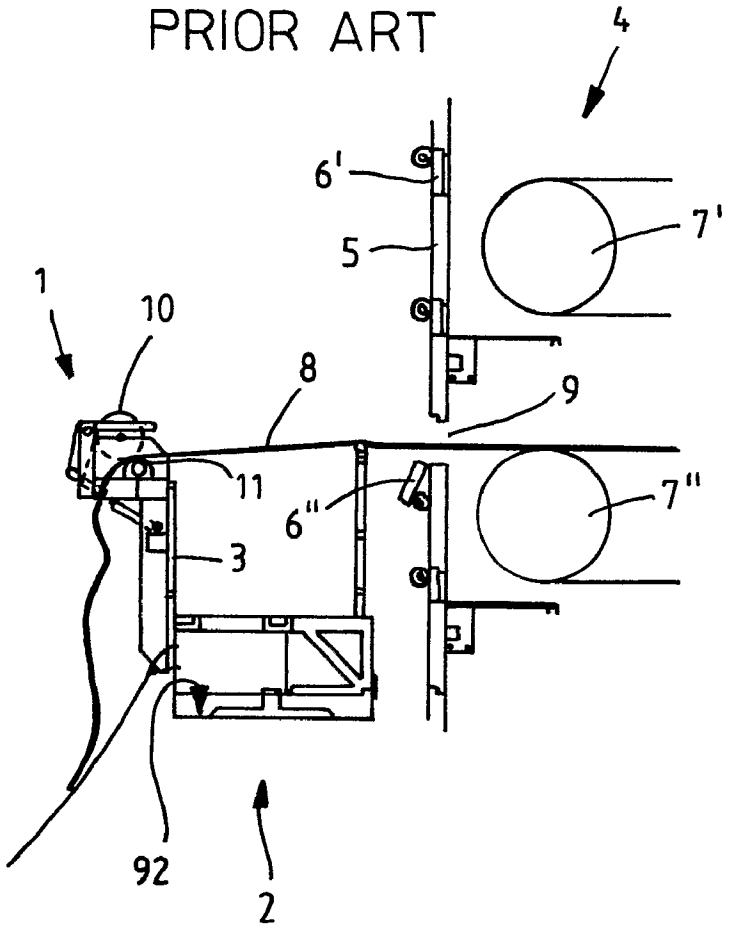
FIG. 1 PRIOR ART
FIG. 1 shows a solution according to prior art.

In FIG. 1 a pulp web extraction device 1 is shown fitted to the rear edge 3 of the maintenance platform 2, i.e. to the edge which is the furthest away from the dryer 4 according to prior art. The end wall 5 of the dryer is provided with doors 6', 6", of which one is open. In the Figure two turn rolls 7', 7" of the dryer are shown. The end of a broken pulp web 8 is pulled from above the lower turn roll 7" seen in the Figure and through an opening 9 of the open access door 6" of the dryer to the extraction device 1 located at the rear edge 3 of the maintenance platform. The extraction device comprises two substantially horizontal rolls 10, 11 transverse to the direction of movement of the pulp web, the pulp web being pulled through a nip formed between the rolls. The extraction device fixed to the rear edge 3 of the maintenance platform is located at a distance of 2-3 meters from the turn roll 7" at which the pulp web 8 is cut after a web break, due to which the end of the pulp web needs to be pulled into the nip of the extraction device 1 for instance manually before its extraction from the dryer 4 by means of the extraction device 1 can be initiated. The pulp web 8 travels over the floor 92 of the maintenance platform 2 inconveniently such that it is difficult to work on the maintenance platform during the removal of the broken pulp web from the pulp dryer 4.

In FIG. 2 a pulp web extraction device 1 is shown fitted to the front edge 12 of the maintenance platform 2, i.e. at the edge facing the dryer 4 according to an embodiment of the invention. The end of the broken pulp web 8 is pulled through the opening 9 of the open access door 6" via the nip of the rolls 10, 11 of the extraction device 1 located at the front edge 12 of the maintenance platform. An extraction device 1 arranged at the front edge of the maintenance platform 2 can be arranged, according to the Figure, very close to that turn roll 7", at which the broken pulp web 8 has been cut. Therefore, the end of the pulp web can be easily taken out of the dryer 4 and placed in the nip between the rolls 10, 11, and there is no need to move the entire pulp web by pulling it. If the pulp web is cut at a location 13 below the lower turn roll 7" in a situation according to the Figure, the end of the pulp web very easily extends to the nip of the extraction device without any need to move the entire web for instance by pulling it. The pulp web can be cut below the turn roll 7" for instance with the aid of a cutting means 15. After the nip of the extraction device the pulp web 8 is guided to travel by the lower edge of the maintenance platform front part 12 down to a broke conveyor 14. There is plenty of working space on the maintenance platform 2, as the pulp web 8 does not travel over the floor 92 of the maintenance platform, as is the case in the solution according to prior art.

Figure 3:
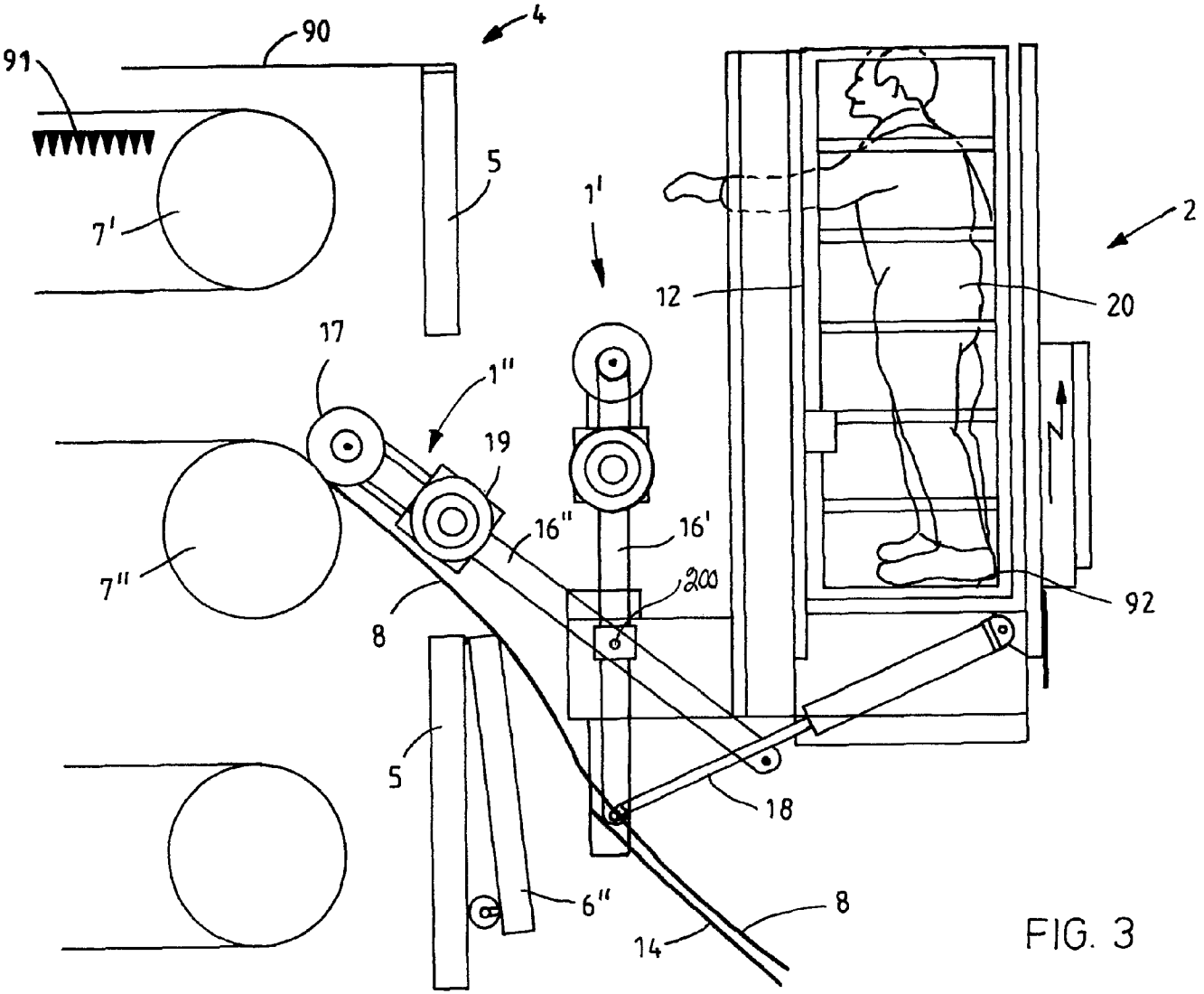
FIG. 3 shows an apparatus according to a second embodiment of the invention.

In FIG. 3 an extraction device 1', 1" is shown arranged in connection with the front edge of the maintenance platform 2 according to an embodiment of the invention. The extraction device comprises a swinging arm 16', 16" and a backing roll 17 arranged in connection with it. In the example of the figure, the extraction device 1', 1" is arranged in connection with the edge 12 of the maintenance platform 2 facing the dryer 4. The backing roll 17 of the extraction device is arranged substantially at the end of the swinging arm 16', 16". By means of a cylinder 18, the swinging arm is turnable with respect to a supporting point 200 into a use position and into a standing position, both positions being simultaneously presented in the Figure. In the use position the swinging arm 16" of the extraction device 1" is turned such that the backing roll 17 is set against one turn roll 7" of the dryer. In the example of the Figure the extraction device comprises an actuator 19, by means of which the backing roll 17 can be used, i.e. rotated. During the removal of a broken pulp web 8 from the dryer 4, the maintenance platform 2 is driven to a suitable height and an access door 6" is opened in the end wall 5 of the dryer. The turn rolls 7', 7" are disengaged so that they can be freely rotated. The pulp web 8 is set to travel from between the backing roll 17 and the turn roll 7". The backing roll 17 is pressed firmly against the turn roll 7" by means of the swinging arm and the cylinder, and it is rotated by means of the actuator 19, whereby also the turn roll 7" rotates and the pulp web 8 can be extracted from the dryer 4. The pulp web is guided from the space between the maintenance platform 2 and the end wall 5 of the dryer to the broke conveyor 14 or directly on the mill floor. If necessary, also the turn rolls 7', 7" can be rotated by means of an operating switch of the turn rolls, the operating switch being arranged in connection with the maintenance bridge.

In FIG. 3 the extraction device 1' is shown also in a standing position, in which case the device 1' is turned out from the inside of the dryer. In the example of the Figure the swinging arm 16' of the extraction device 1' is in its standing position locked in an essentially vertical position, whereby the maintenance platform 2 can be shifted up or down along the end wall 5 of the pulp dryer. When using an extraction device 1', 1" according to the example of the Figure the operator 20 has enough space to move on the maintenance platform 2, as the pulp web 8 does not travel through or over the maintenance platform. One of the advantages of an extraction device 1', 1" according to the example is that the pulp web 8 needs not to be manually extracted from the dryer 4, as the backing roll 17 of the device 1', 1" is set inside the dryer 4 against the turn roll 7". FIG. 3 shows the roof 90 of the pulp dryer and schematically one nozzle level 91. The maintenance platform 2 is arranged on such a long rail means that it can be guided even higher than the level presented in the Figure, beyond the roof 90.

Figure 4:
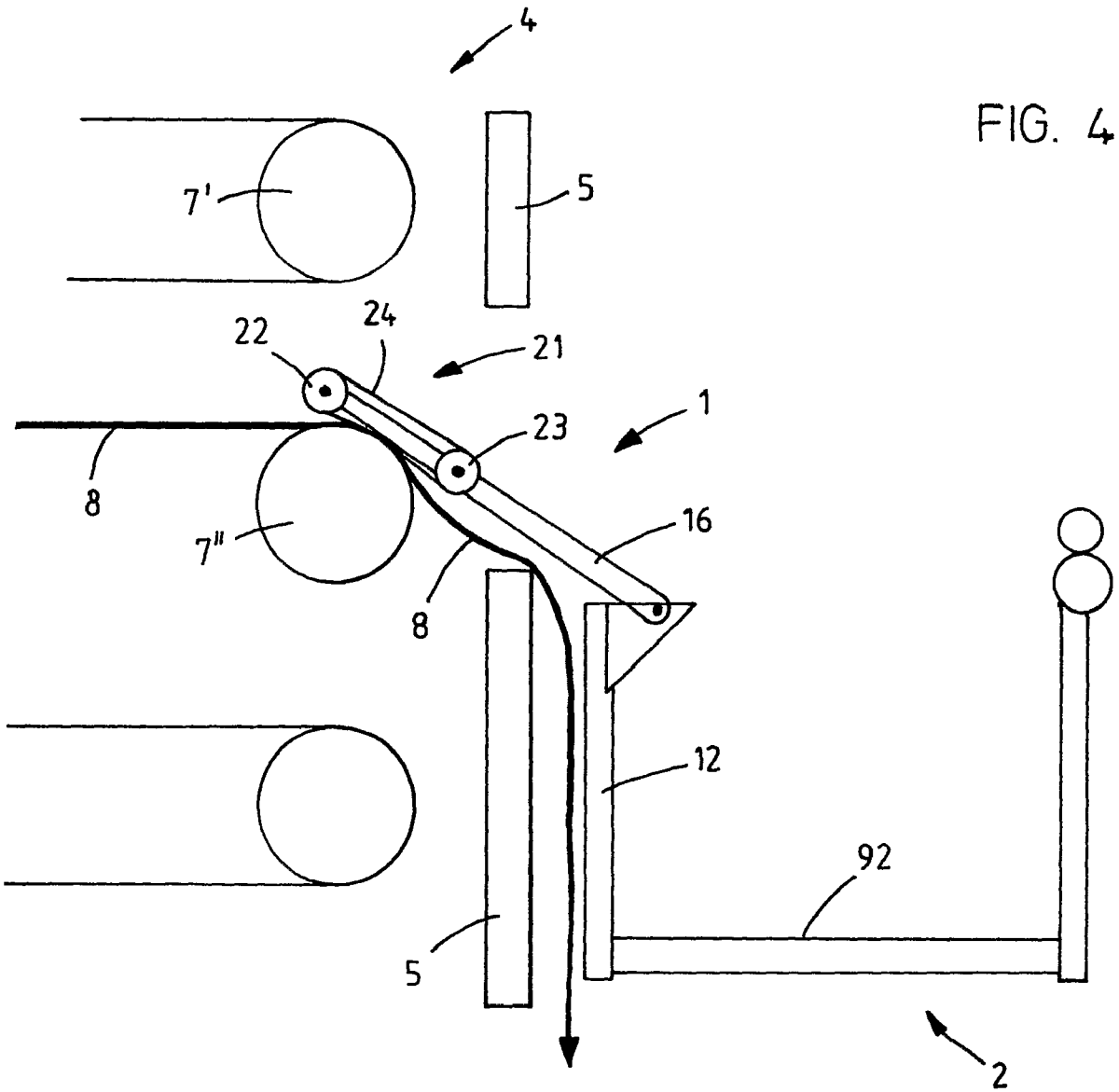
FIG. 4 shows an apparatus according to a third embodiment of the invention.

In FIG. 4 a pulp web extraction device 1 according to an embodiment of the invention arranged in connection with the maintenance platform 2 is shown. In this example the extraction device 1 is fixed to the front edge 12 of the maintenance platform 2, i.e. to the edge facing the dryer 4. The maintenance platform 2 is movable and can therefore be driven to a desired height, whereby a broken pulp web 8 can be removed at different locations of the dryer 4. A door is opened at the end wall 5 of the dryer so that the extraction device 1 can be arranged partly inside the dryer 4. The extraction device 1 comprises a swinging arm 16 and a belt device 21 arranged at the end thereof, which belt device is set against the turn roll 7" according to the Figure. The swinging arm 16 of the extraction device can be turned manually or by using mechanical auxiliary devices. According to an embodiment the extraction device 1 comprises an actuator, such as a motor by means of which the belt device 21 is rotated. According to an embodiment the pulp web 8 can be removed from the dryer 4 by rotating the turn rolls 7', 7" of the dryer. The belt device 21 usually comprises at least two wheel parts 22, 23 and an endless belt 24 arranged around them. In an embodiment there are three, four or five wheel parts and they are arranged in succession in the form of an arc such that the belt device can be fitted very tightly against the turn roll 7". In the example of the Figure the wheel parts 22, 23 are so far away from each other that only the belt 24 of the belt device 21 is in touch with the turn roll 7". The wheel part 22, 23 can be divided in several pieces in the lateral direction of the pulp web. According to an embodiment the wheel parts are formed of at least two cogged wheels and according to an embodiment the wheel part is an elongated cogged roll. The belt device 21 can comprise one belt 24 having substantially the width of the pulp web or several belts which are substantially narrower than the pulp web. The belt 24 can be made of rubber, for example. The belt can be smooth, but advantageously the belt, especially a rubber belt, is patterned whereby sliding of the belt with respect to the pulp web can be avoided.

Figure 5:
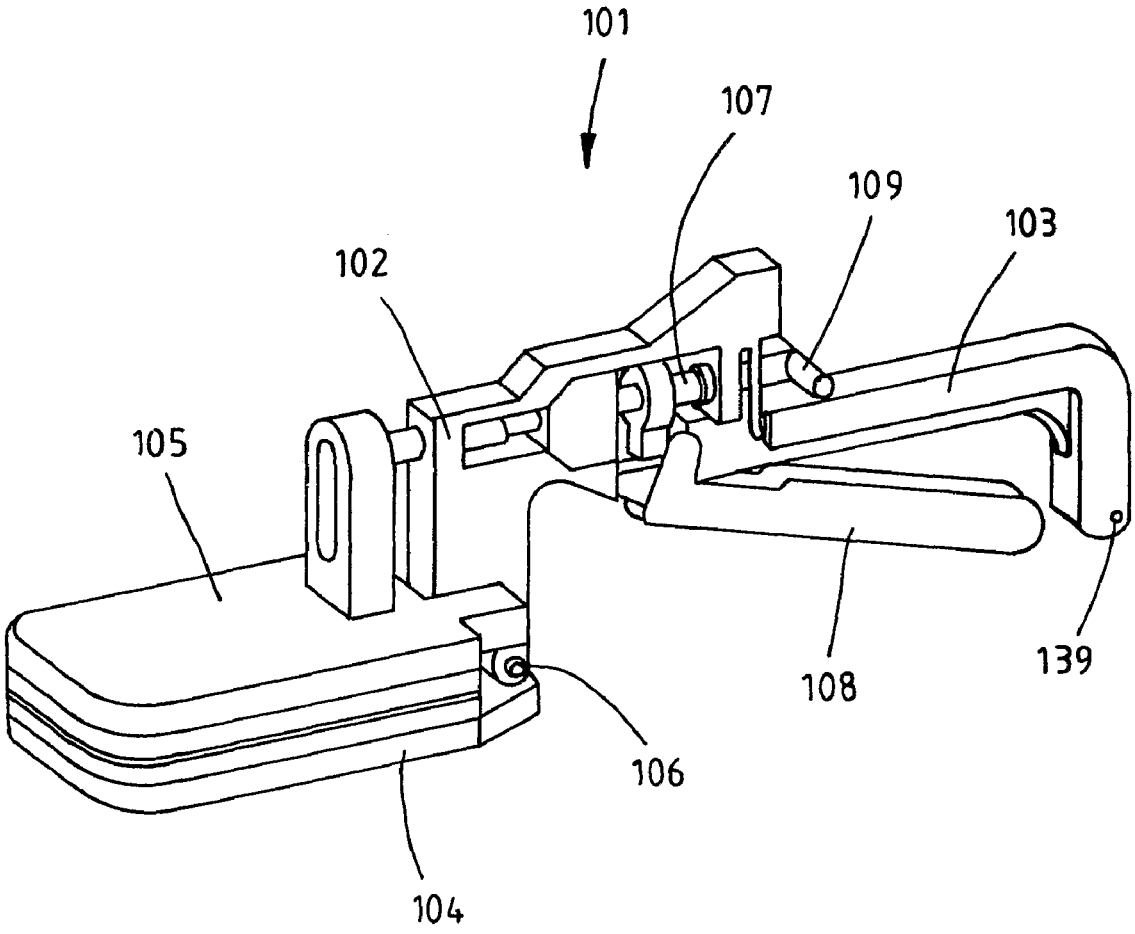
FIG. 5 shows a gripping means according to a fourth embodiment of the invention.

FIG. 5 shows, according to an embodiment of the invention, a gripping means 101 of the gripping system in a closed position. The gripping means 101 has a frame 102 and a handle member 103 and a lower jaw 104 made of the same piece as the frame. The upper jaw 105 is articulated to the frame with a hinge 106. In the illustrated closed position, the planar upper jaw 105 and the lower jaw 104 of the gripping means are locked against each other. When placed between the closed jaws, the pulp web is not able to move substantially with respect to the planes of the gripping means. A locking part 107 and a trigger 108 articulated to the frame and an opening button 109, both functionally connected to the locking part, are also fixed to the frame 102. The locking part 107 communicates with the upper jaw 105 such that when the trigger 108 is pressed, the jaws 104 and 105 are pressed against each other. The jaws 104 and 105 are opened, i.e. the gripping means is brought into an open position, by pressing the opening button 109. The details of the locking and opening mechanisms of the type described above do not constitute the object of this invention, and hence they are not explained in further detail here. The locking and opening mechanisms can be devised separately as necessary. The handle part 103 at the second end of the frame comprises an opening 139 to which a pulling means, such as a wire rope, a chain or other corresponding means can be fixed for pulling the gripping means 101.

Figure 6:
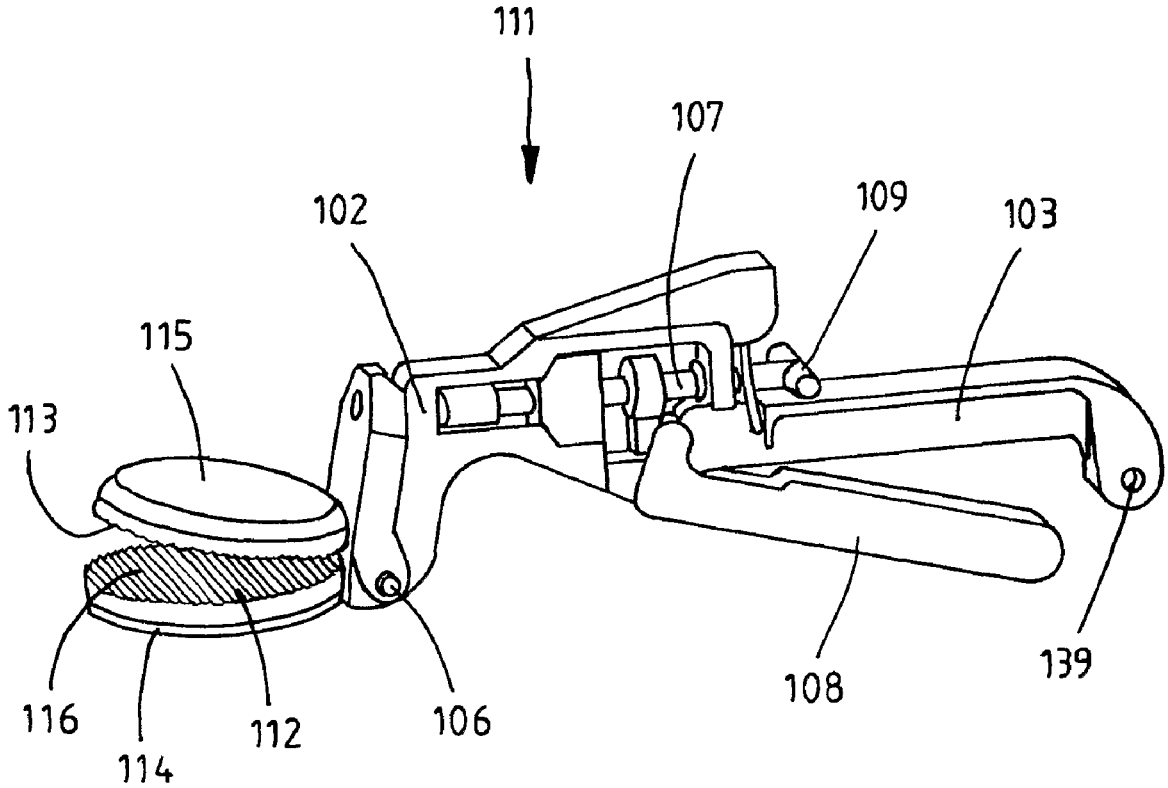
FIG. 6 shows a gripping means according to a fifth embodiment of the invention.

FIG. 6 shows a second embodiment 111 of the gripping means of the gripping system according to an embodiment of the invention, which embodiment 111 mainly corresponds by its structure to the gripping means of FIG. 5, yet the planar lower jaw 114 and the upper jaw 115 being differently shaped than in FIG. 5. The gripping means 111 of FIG. 6 is in an open position, i.e. the upper jaw and the lower jaw are at an angle with respect to each other. When the gripping means is in this position, the broken pulp web can be placed between the jaws. FIG. 6 shows how the surface 112 of the lower jaw and the surface 113 of the upper jaw fitted against it are equipped with matching teeth or grooves 116 in order to achieve an enhanced grip between the surfaces of the jaws of the gripping means 111 and the pulp web. The friction surfaces 112 and 113 of the gripping means typically have an approximate area of 100 $cm^2$.

Figure 7:
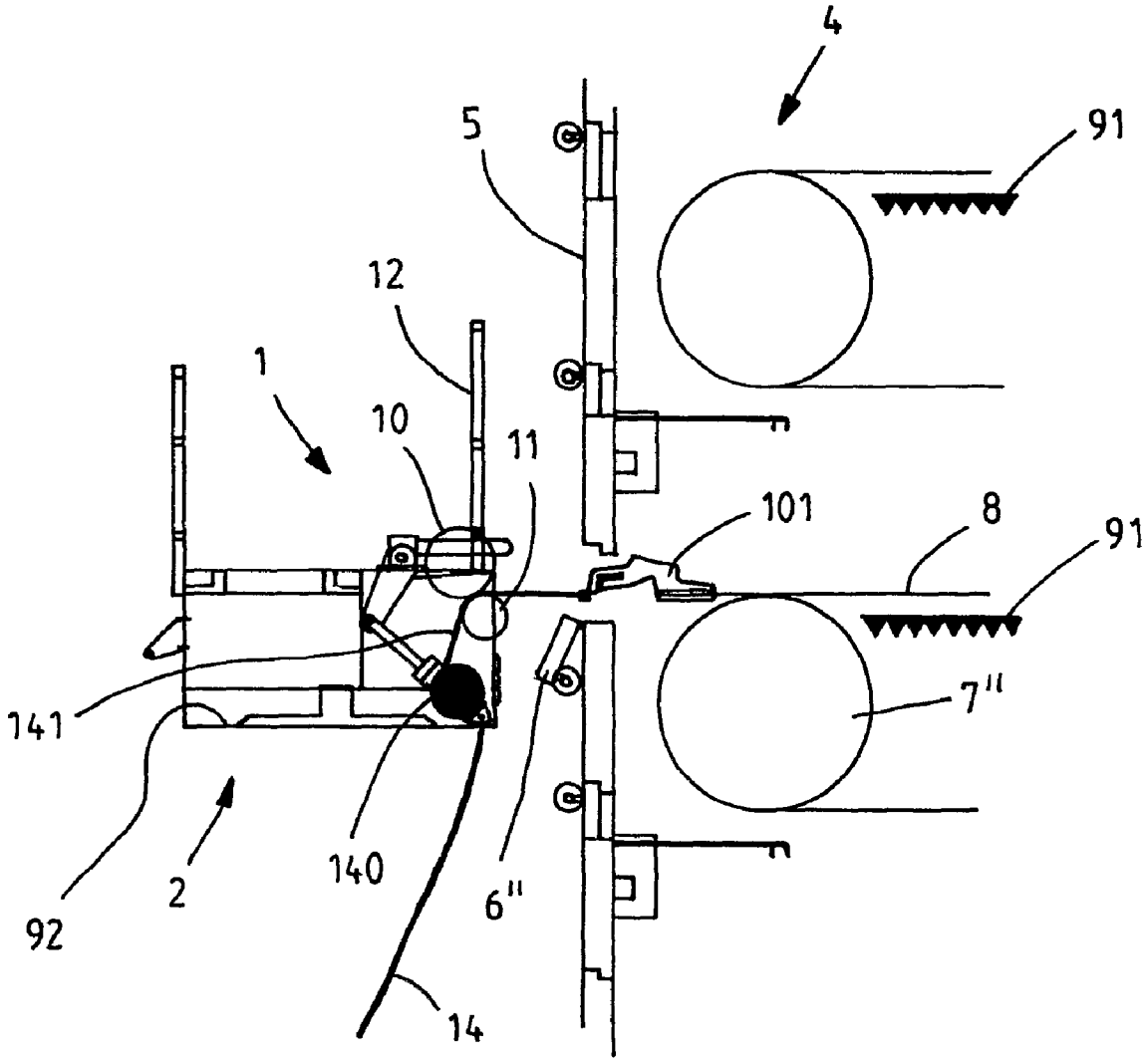
FIG. 7 shows an apparatus according to a sixth embodiment of the invention.

FIG. 7 shows the use of the gripping means 101 of FIG. 5 in an apparatus resembling the apparatus of FIG. 2. The end of the broken pulp web 8 has been gripped by the gripping means 101. A chain 141 is fixed to the opening of the gripping means 101, the chain being presently wound to the reel 140 of the pulling means. The chain travels through the open nip of the rolls 10 and 11. When the gripping means 101 has been passed from between the rolls 10 and 11, the nip between them is closed, and the pulp web 8 remains tightly between the rolls 10 and 11. Then, rotating of the rolls 10 and 11 is initiated with the actuator of the extraction device such that the pulp web 8 is extracted from the pulp dryer 4. FIG. 7 schematically illustrates nozzle levels 91 through which air is blown in order to float the pulp web 8 in the dryer 4. FIG. 7 also shows how the maintenance platform floor 92 remains free for the working of the operators of the device.

Only one advantageous embodiment of the invention is shown in the Figures. The Figures do not separately show matters that are irrelevant in view of the main idea of the invention, known as such or obvious as such for a person skilled in the art. It is apparent to a person skilled in the art that the invention is not limited exclusively to the examples described above, but that the invention can vary within the scope of the claims presented below. For instance, even though this text generally refers to a pulp dryer, it is clear that the invention is also excellently suited to attending to web breaks in devices where other web-like products are handled. The dependent claims present some possible embodiments of the invention, and they are not to be considered to restrict the scope of protection of the invention as such.

The invention claimed is:

1. An apparatus for removing a broken pulp web from a pulp dryer, the apparatus comprising:

a maintenance platform positioned outside a wall of the pulp dryer and having an edge facing the pulp dryer;

means for shifting the maintenance platform in a substantially vertical direction; and an extraction device mounted on the edge of the maintenance platform facing the pulp dryer for pulling a broken pulp web out from the pulp dryer.

2. The apparatus of claim 1, wherein the extraction device comprises two adjacent and substantially aligned rolls forming a nip between the rolls, one of the rolls being capable of shifting with respect to the other of the rolls to open or close the nip.

3. The apparatus of claim 1, wherein the extraction device comprises:

a pulling means;

a gripping means coupled to the pulling means and comprising means for engaging the pulp web; and an actuator operably coupled to the pulling means for driving the pulling means and actuating the gripping means via the pulling means.

4. The apparatus of claim 3, wherein the pulling means comprises a dummy coupling for shifting the gripping means towards the pulp web.

5. The apparatus of claim 3, wherein the means for engaging the pulp web comprises first and second planar friction means arranged capable of shifting with respect to each other between a closed position and an open position, the first and second planar friction means having respective planes, and the planes of the first and second friction means have substantial parts arranged to be substantially in mutual contact in the closed position and be substantially separated from each other in the open position.

6. The apparatus of claim 1, wherein the means for shifting the maintenance platform comprises substantially vertical rail means, the rail means having an upper end extending above a roof of the pulp dryer.

7. The apparatus of claim 1 further comprising means for shifting the extraction device in a substantially vertical direction with respect to the maintenance platform.

8. The apparatus of claim 1 further comprises means for shifting the extraction device with respect to the maintenance platform towards or away from the pulp dryer.

9. The apparatus of claim 1 further comprising means for turning the extraction device in relation to the maintenance platform so that the extraction device can be tilted towards the pulp dryer.

10. A pulp dryer comprising:

a plurality of superimposed nozzle levels on which a pulp web to be dried is arranged to be conveyed;

a plurality of turn rolls for directing the pulp web from one of the nozzle levels to another one of the nozzle levels;

a wall and a roof substantially surrounding the nozzle levels and the turn rolls; and the apparatus of claim 1 for removing a broken pulp web from the pulp dryer.

* * * * *